US012800201B2

(12) United States Patent
Shaffer et al.

(10) Patent No.: US 12,800,201 B2
(45) Date of Patent: Nov. 17, 2026

(54) AIR CONDITIONER WITH CROSS-OVER REFRIGERANT FLOW

(71) Applicant: Haier US Appliance Solutions, Inc., Wilmington, DE (US)

(72) Inventors: Timothy Scott Shaffer, La Grange, KY (US); Joshua Longenecker, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 395 days.

(21) Appl. No.: 18/448,828

(22) Filed: Aug. 11, 2023

(65) Prior Publication Data

US 2025/0052458 A1 Feb. 13, 2025

(51) Int. Cl.

| | |
|---|---|
| ***F25B 13/00*** | (2006.01) |
| ***F25B 30/00*** | (2006.01) |
| ***F25B 41/30*** | (2021.01) |

(52) U.S. Cl.

CPC ..... *F25B 41/30* (2021.01); *F25B 13/00* (2013.01); *F25B 30/00* (2013.01); *F25B 2313/027* (2013.01); *F25B 2600/2513* (2013.01)

(58) Field of Classification Search

CPC ..... F25B 41/30; F25B 13/00; F25B 30/00; F25B 2313/027; F25B 2600/2513

See application file for complete search history.

(56) References Cited

U.S. PATENT DOCUMENTS

| | | | | |
|---|---|---|---|---|
| 10,139,143 | B2 | 11/2018 | Havard, Jr. et al. | |
| 2007/0056302 | A1* | 3/2007 | Otake | F25B 29/003 62/243 |
| 2016/0245561 | A1* | 8/2016 | Tanaka | F25B 13/00 |
| 2020/0386458 | A1* | 12/2020 | Shaffer | F25B 49/02 |
| 2026/0036347 | A1* | 2/2026 | Tanaka | F25B 29/003 |

FOREIGN PATENT DOCUMENTS

| | | | | |
|---|---|---|---|---|
| CN | 109323433 | A | 2/2019 | |
| EP | 1477748 | B1 | 9/2013 | |
| JP | 2003106694 | A | 4/2003 | |
| WO | WO-2022211077 | A1 * | 10/2022 | F25B 7/00 |

OTHER PUBLICATIONS

For1,Refrigeration cycle device, 2022, Full Document (Year: 2022).*

* cited by examiner

*Primary Examiner* — Nael N Babaa
(74) *Attorney, Agent, or Firm* — Dority & Manning, P.A.

(57) ABSTRACT

An air conditioner unit comprises a sealed cooling system including an outdoor heat exchanger and an indoor heat exchanger. The sealed cooling system includes multiple refrigerant circuits. Each refrigerant circuit of the multiple refrigerant circuits includes an expansion device. A cross-over flow connection extends between and provides fluid communication between each of the multiple refrigerant circuits. The cross-over flow connection is adjacent the expansion device of each refrigerant circuit.

13 Claims, 4 Drawing Sheets

AIR CONDITIONER WITH CROSS-OVER REFRIGERANT FLOW

FIELD OF THE INVENTION

The present subject matter relates generally to air conditioning appliances, and more particularly to air conditioning appliances having multiple refrigerant circuits or a branching refrigerant circuit, and which include a cross-over flow connection between the multiple circuits or multiple branches.

BACKGROUND OF THE INVENTION

Air conditioner units or air conditioning appliance units are conventionally utilized to adjust the temperature within structures such as dwellings and office buildings. In particular, one-unit type room air conditioner units, such as single-package vertical units (SPVU), or package terminal air conditioners (PTAC) may be utilized to adjust the temperature in, for example, a single room or group of rooms of a structure. A typical one-unit type air conditioner or air conditioning appliance includes an indoor portion and an outdoor portion. The indoor portion generally communicates (e.g., exchanges air) with the area within a building, and the outdoor portion generally communicates (e.g., exchanges air) with the area outside a building. Accordingly, the air conditioner unit generally extends through, for example, an outer wall of the structure. Generally, a fan may be operable to rotate to motivate air through the indoor portion. Another fan may be operable to rotate to motivate air through the outdoor portion. A sealed cooling system including a compressor is generally housed within the air conditioner unit to treat (e.g., cool or heat) air as it is circulated through, for example, the indoor portion of the air conditioner unit. One or more control boards are typically provided to direct the operation of various elements of the particular air conditioner unit.

In some air conditioner units, the sealed cooling system may include multiple circuits or multiple branches of a refrigerant circuit in which refrigerant flows in parallel through the indoor and outdoor heat exchangers. Where each circuit has a minimum operating limit, e.g., minimum flow rate, the overall minimum flow rate through each heat exchanger may be the sum of the minimum for all circuits. Accordingly, the lower limit of the operating range may be higher than desired.

As a result, further improvements to air conditioners may be advantageous. In particular, it would be useful to provide higher fidelity flow control and wider operating range for air conditioners with multiple refrigerant circuits or a branching circuit.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an air conditioner unit is provided. The air conditioner unit includes an outdoor heat exchanger and an indoor heat exchanger. The air conditioner unit also includes a sealed cooling system. The sealed cooling system includes the indoor heat exchanger and the outdoor heat exchanger. The sealed cooling system also includes multiple refrigerant circuits. Each refrigerant circuit of the multiple refrigerant circuits includes an expansion device. A cross-over flow connection extends between and provides fluid communication between each of the multiple refrigerant circuits. The cross-over flow connection is adjacent the expansion device of each refrigerant circuit.

In another exemplary aspect of the present disclosure, a method of operating an air conditioner unit is provided. The air conditioner unit includes an outdoor heat exchanger, an indoor heat exchanger, and a sealed cooling system including the indoor heat exchanger and the outdoor heat exchanger. The sealed cooling system also includes multiple refrigerant circuits and a cross-over flow connection extending between and providing fluid communication between each of the multiple refrigerant circuits. The method includes measuring a superheat in the sealed cooling system and comparing the measured superheat to a predetermined threshold. The method further includes fully closing at least one electronic expansion valve in one of the multiple refrigerant circuits in response to the measured superheat greater than the predetermined threshold.

In another exemplary aspect of the present disclosure, an air conditioner unit is provided. The air conditioner unit includes an outdoor heat exchanger and an indoor heat exchanger. The air conditioner unit also includes a sealed cooling system. The sealed cooling system includes the indoor heat exchanger and the outdoor heat exchanger. The sealed cooling system also includes multiple refrigerant circuits and a cross-over flow connection extending between and providing fluid communication between each of the multiple refrigerant circuits. The air conditioner unit further includes a controller, the controller is configured for measuring a superheat in the sealed cooling system and comparing the measured superheat to a predetermined threshold. The controller is further configured for fully closing at least one electronic expansion valve in one of the multiple refrigerant circuits in response to the measured superheat greater than the predetermined threshold.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
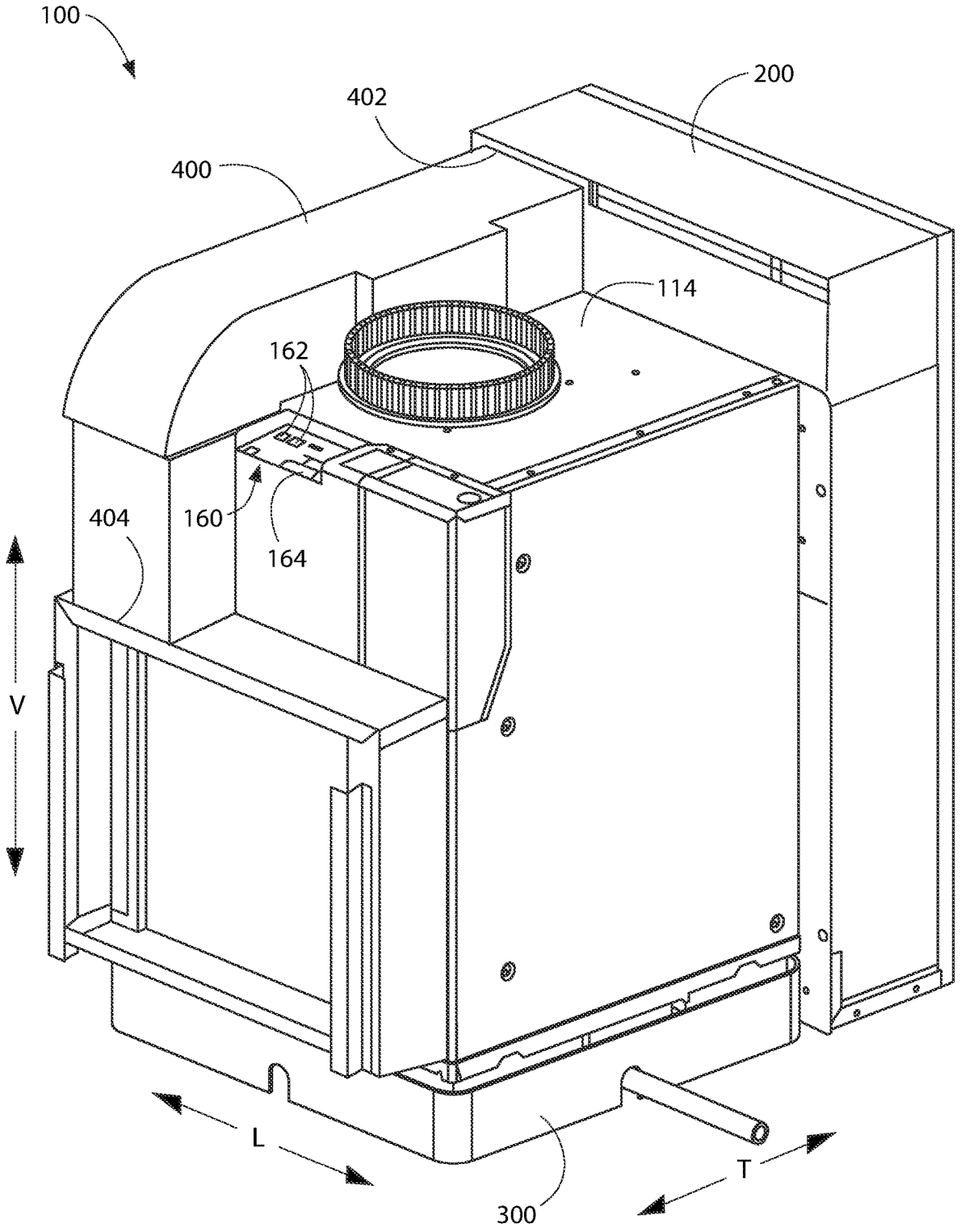
FIG. 1 provides a perspective view of an air conditioner unit according to one or more exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counterclockwise.

Figure 2:
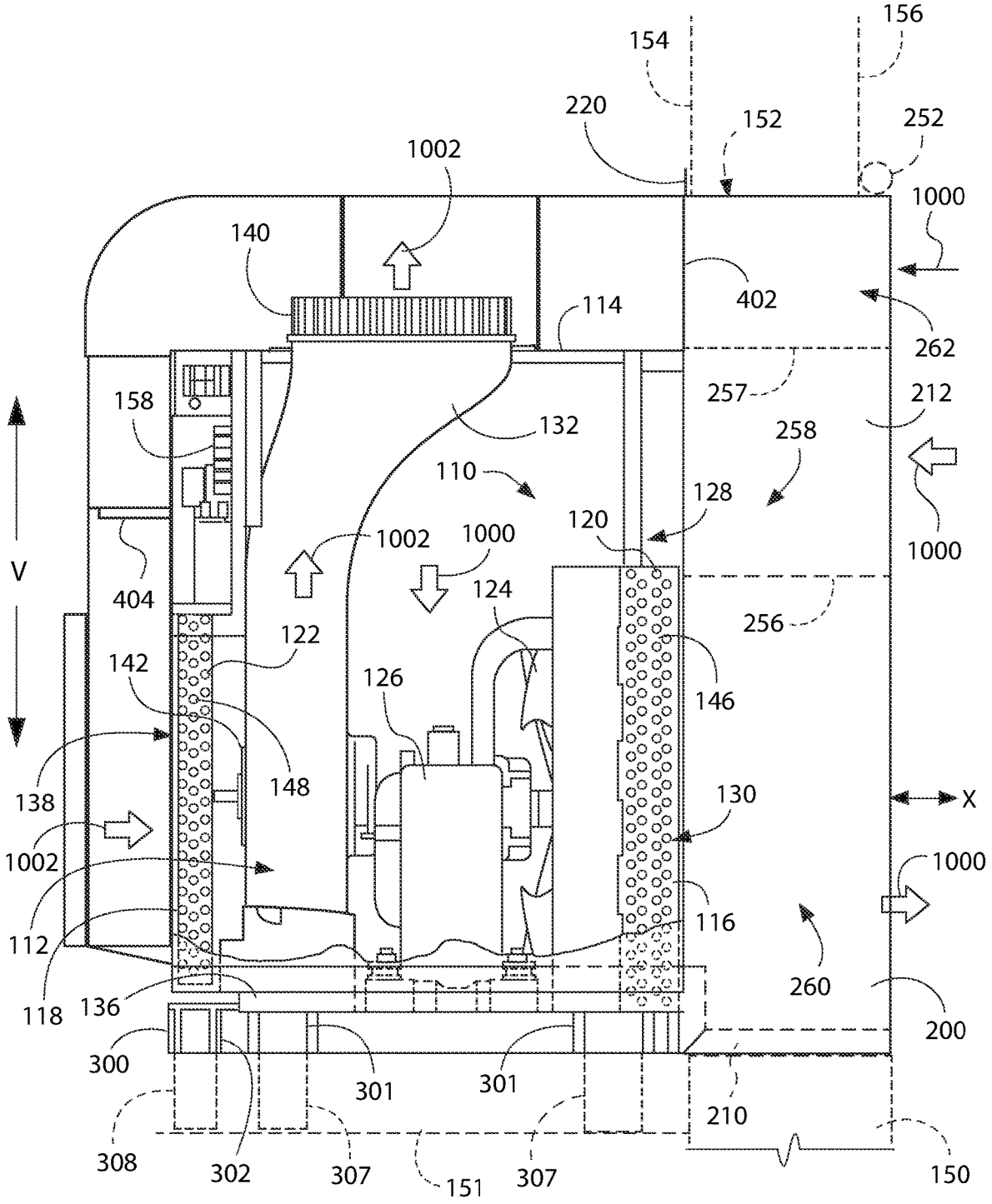
FIG. 2 provides a section view of the air conditioner unit of FIG. 1 according to one or more exemplary embodiments of the present disclosure.

Turning now to the figures, FIGS. 1 and 2 illustrate an exemplary air conditioner appliance or air conditioner unit (e.g., air conditioner 100). As shown, air conditioner 100 may be provided as a one-unit type air conditioner 100, such as a single-package vertical unit. Air conditioner 100 includes a package housing 114 supporting an indoor portion 112 and an outdoor portion 110.

Generally, air conditioner 100 defines a vertical direction V, lateral direction L, and transverse direction T. Each direction V, L, T is mutually perpendicular with every other direction, such that an orthogonal coordinate system is generally defined.

In some embodiments, housing 114 contains various other components of the air conditioner 100. Housing 114 may include, for example, a rear opening 116 (e.g., with or without a grill or grate thereacross) and a front opening 118 (e.g., with or without a grill or grate thereacross) may be spaced apart from each other along the transverse direction T. The rear opening 116 may be part of the outdoor portion 110, while the front opening 118 may be part of the indoor portion 112. Components of the outdoor portion 110, such as an outdoor heat exchanger 120, outdoor fan 124, and compressor 126 may be enclosed within housing 114 between front opening 118 and rear opening 116. In certain embodiments, one or more components are mounted on a base 136, as shown. The base 136 may be received on or within a drain pan 300.

During certain operations, air 1000 may be drawn to outdoor portion 110 through rear opening 116. Specifically, an outdoor inlet 128 defined through housing 114 may receive outdoor air 1000 motivated by outdoor fan 124. Within housing 114, the received outdoor air 1000 may be motivated through or across outdoor fan 124. Moreover, at least a portion of the outdoor air 1000 may be motivated through or across outdoor heat exchanger 120 before exiting the rear opening 116 at an outdoor outlet 130. It is noted that although outdoor inlet 128 is illustrated as being defined above outdoor outlet 130, alternative embodiments may reverse this relative orientation (e.g., such that outdoor inlet 128 is defined below outdoor outlet 130) or provide outdoor inlet 128 beside outdoor outlet 130 in a side-by-side orientation, or another suitable orientation.

As shown, indoor portion 112 may include an indoor heat exchanger 122, and an indoor fan 142, e.g., a blower fan 142 as in the illustrated example embodiment. These components may, for example, be housed behind the front opening 118. A bulkhead may generally support or house various other components or portions of the indoor portion 112, such as the blower fan 142. The bulkhead may generally separate and define the indoor portion 112 and outdoor portion 110 within housing 114.

During certain operations, air 1002 may be drawn to indoor portion 112 through front opening 118. Specifically, an indoor inlet 138 defined through housing 114 may receive indoor air 1002 motivated by blower fan 142. At least a portion of the indoor air 1002 may be motivated through or across indoor heat exchanger 122 before passing to a duct 132. The indoor air 1002 may be motivated (e.g., by fan 142) into and through the duct 132 and returned to the indoor area of the room through an indoor outlet 140 defined through housing 114 (e.g., above indoor inlet 138 along the vertical direction V). Optionally, one or more conduits (not pictured) may be mounted on or downstream from indoor outlet 140 to further guide air 1002 from air conditioner 100. It is noted that although indoor outlet 140 is illustrated as generally directing air upward, it is understood that indoor outlet 140 may be defined in alternative embodiments to direct air in any other suitable direction.

Outdoor and indoor heat exchangers 120, 122 may be components of a thermodynamic assembly (i.e., sealed system 320, illustrated in FIG. 3 and described in further detail with reference to FIG. 3 below), which may be operated as a refrigeration assembly (and thus perform a refrigeration cycle) or, in the case of the heat pump unit embodiment, a heat pump (and thus perform a heat pump cycle). Thus, as is understood, exemplary heat pump unit embodiments may be selectively operated to perform a refrigeration cycle at certain instances (e.g., while in a cooling mode) and a heat pump cycle at other instances (e.g., while in a heating mode). By contrast, exemplary A/C exclusive unit embodiments may be unable to perform a heat pump cycle (e.g., while in the heating mode), but still perform a refrigeration cycle (e.g., while in a cooling mode).

Figure 3:
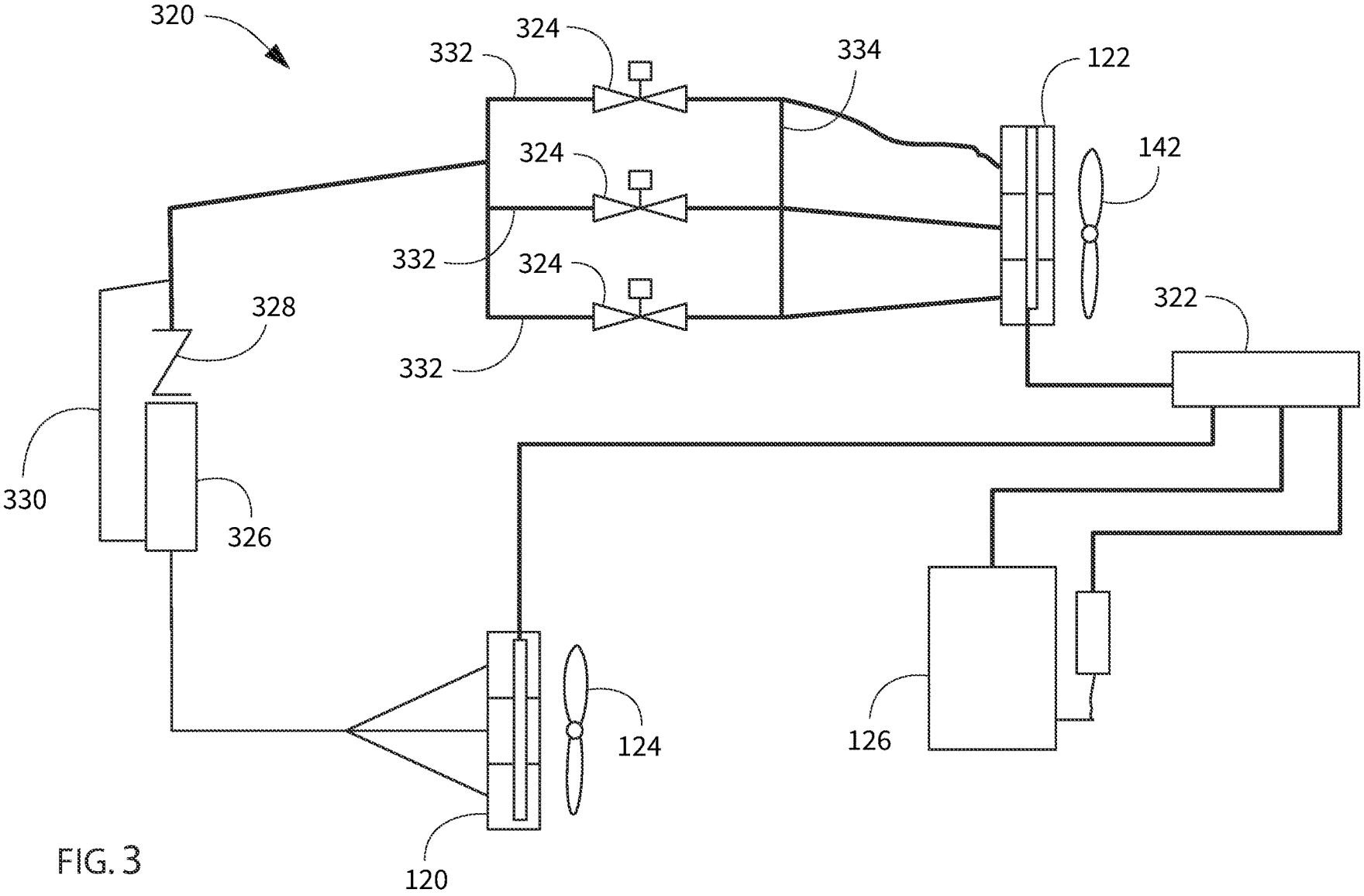
FIG. 3 provides a schematic illustration of an exemplary sealed system as may be incorporated into an air conditioner unit such as the air conditioner unit of FIG. 1.

The sealed system may, for example, further include compressor 126 (e.g., mounted on base 136) and an expansion device (e.g., expansion valve or capillary tube, such as the electronic expansion valves 324 illustrated in FIG. 3), both of which may be in fluid communication with the heat exchangers 120, 122 to flow refrigerant therethrough, as is generally understood. The outdoor and indoor heat exchangers 120, 122 may each include coils 146, 148, as illustrated, through which a refrigerant may flow for heat exchange purposes, as is generally understood. Moreover, as may be seen in FIG. 3, heat exchangers 120, 122 may each include multiple circuits therethrough, such as three circuits as illustrated.

A plenum 200 may be provided to direct air to or from housing 114. When installed, plenum 200 may be selectively attached to (e.g., fixed to or mounted against) housing 114 (e.g., via a suitable mechanical fastener, adhesive, gasket, etc.) and extend through a structure wall 150 (e.g., an outer wall of the structure within which air conditioner 100 is installed) and above a floor 151. In particular, plenum 200 extends along an axial direction X (e.g., parallel to the transverse direction T) through a hole or channel 152 in the structure wall 150 that passes from an internal surface 154 to an external surface 156. Optionally, a caulk bead 252 (i.e., adhesive or sealant caulk) may be provided to join the plenum 200 to the external surface 156 of structure wall 150 (e.g., about or outside from wall channel 152).

The plenum 200 includes a duct wall 212 that is formed about the axial direction X (e.g., when mounted through wall channel 152). Duct wall 212 may be formed according to any suitable hollow shape, such as conduit having a rectangular profile (shown), defining an air channel 210 to guide air therethrough. Moreover, duct wall 212 may be formed from any suitable non-permeable material (e.g., steel, aluminum, or a suitable polymer) for directing or guiding air therethrough. In certain embodiments, plenum 200 further includes an outer flange 220 that extends in a radial direction (e.g., perpendicular to the axial direction X) from duct wall 212. Specifically, outer flange 220 may extend radially outward (e.g., away from at least a portion of the axial direction X or the duct wall 212).

In some embodiments, plenum 200 includes a divider wall 256 within air channel 210. When assembled, divider wall 256 defines a separate upper passage 258 and lower passage 260. For instance, divider wall 256 may extend along the lateral direction L from one lateral side of plenum 200 to the other lateral side. Generally, upper passage 258 and lower passage 260 may divide or define two discrete air flow paths for air channel 210. When assembled, upper passage 258 and lower passage 260 may be fluidly isolated by divider wall 256 (e.g., such that air is prevented from passing directly between passages 258 and 260 through divider wall 256, or another portion of plenum 200). Upper passage 258 may be positioned upstream from outdoor inlet 128. Lower passage 260 may be positioned downstream from outdoor outlet 130.

The plenum 200 may further include a second divider wall 257 which separates a make-up air passage 262 from the remainder of the air channel 210, such as from the upper passage 258 and the lower passage 260. For example, the make-up air passage 262 may be positioned directly above the upper passage 258, whereby the second divider separates and partially defines the make-up air passage 262 and the upper passage 258, e.g., as in the exemplary embodiment illustrated in FIG. 2. Similar to the divider wall 256 described above, the second divider wall 257 may extend along the lateral direction L from one lateral side of plenum 200 to the other lateral side. The make-up air passage 262 may thereby define a discrete air flow path within air channel 210 which is separate and distinct from the upper and lower passages 258 and 260. When assembled, the make-up air passage 262 may be fluidly isolated by the second divider wall 257 from one or both of the upper passage 258 and lower passage 260, e.g., such that air is prevented from passing directly between the make-up air passage 262 and the upper and lower passages 258 and 260 through the second divider wall 257, or any other portion of plenum 200). The make-up air passage 262 may be positioned upstream from a make-up air duct 400. In some embodiments, outdoor air 1000 may be drawn into the make-up air duct 400 by a make-up air fan via the make-up air passage 262. The make-up air duct 400 may extend from a first end 402 at the make-up air passage 262 of the plenum 200 to a second end 404 at the indoor portion 112 of the housing 114, e.g., upstream of the indoor inlet 138, whereby outdoor air, e.g., make-up air, may be provided directly to the indoor portion 112 of the air conditioner 100 via the make-up air duct 400. Thus, the make-up air duct 400 may be a component of a make-up air system or make-up air assembly.

The operation of air conditioner 100 including compressor 126 (and thus the sealed system 320 generally), indoor fan 142, outdoor fan 124, and other suitable components may be controlled by a control board or controller 158. Controller 158 may be in communication (via for example a suitable wired or wireless connection) to such components of the air conditioner 100. By way of example, the controller 158 may include a memory and one or more processing devices such as microprocessors, CPUs or the like, such as general or special purpose microprocessors operable to execute programming instructions or micro-control code associated with operation of air conditioner 100. The memory may be a separate component from the processor or may be included onboard within the processor. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 158 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Further, it should be understood that controllers 158 as disclosed herein are capable of and may be operable to perform any methods and associated method steps as disclosed herein.

Air conditioner 100 may additionally include a control panel 160 (FIG. 1) and one or more user inputs 162, which may be included in control panel 160. The user inputs 162 may be in communication with the controller 158. A user of the air conditioner 100 may interact with the user inputs 162 to operate the air conditioner 100, and user commands may be transmitted between the user inputs 162 and controller 158 to facilitate operation of the air conditioner 100 based on such user commands. A display 164 may additionally be provided in the control panel 160, and may be in communication with the controller 158. Display 164 may, for example be a touchscreen or other text-readable display screen, or alternatively may simply be a light that can be activated and deactivated as required to provide an indication of, for example, an event or setting for the air conditioner 100.

Also as may be seen in FIG. 2, in some instances when the plenum 200 is installed within the wall 150 above the floor 151, the remainder of the air conditioner unit 100 may be suspended or cantilevered from the plenum 200. In order to avoid such cantilever, one or more support legs 307 and/or 308 may be provided between the drain pan 300 and the floor 151, whereby at least some of the weight of the remaining components of the air conditioner unit 100 is shifted off of the plenum 200. Where the installation height of the plenum 200 above the floor 151 varies, the required height of the leg(s) 307 and/or 308 will also vary. Thus, the leg(s) 307 and/or 308 may be cut in the field and custom-fitted to the specific installation.

The drain pan 300 may include one or more sockets which are configured to receive the leg(s) 307 and/or 308. For example, as illustrated in FIG. 2, the drain pan 300 may include a first socket 301 and a second socket 302. As illustrated in FIG. 2, the socket(s) 301 and/or 302 may be positioned opposite the plenum 200 along the transverse direction T. For example, the plenum 200 may be positioned at a first transverse end of the drain pan 300 and the socket(s) 301/302 may be positioned opposite the plenum 200 at or near a second transverse end of the drain pan 300. Also as may be seen in FIG. 2, in some embodiments, the drain pan 300 may also or instead include one or more of the sockets 301 and/or 302 at the other end of the pan 300, e.g., proximate the plenum 200. In various embodiments, one or both of the sockets 301 and 302 may be provided. In some embodiments, each socket 301 and 302 may be one of a pair of matching shaped sockets which are spaced apart along the lateral direction L and aligned along the transverse direction T.

It should be understood that the illustrated air conditioner 100 is generally referred to as a vertical PTAC system, and this configuration is provided by way of example only. The benefits of the present disclosure apply to other types and styles of air conditioners as well. Consequently, the description set forth herein is for illustrative purposes only and is not intended to be limiting in any aspect to a particular air conditioner unit configuration.

Turning now to FIG. 3, an exemplary sealed system 320, which may be incorporated into various air conditioner units, e.g., such as but not limited to the PTAC illustrated in FIGS. 1 and 2, is schematically depicted. Sealed system 320 generally operates in a heating mode, e.g., heat pump cycle, or a cooling mode, and the mode may be controlled or selected based on the position of a reversing valve 322. Sealed system 320 includes compressor 126, indoor heat exchanger 122 and outdoor heat exchanger 120. As is generally understood, various conduits may be utilized to flow refrigerant between the various components of sealed system 320. Thus, e.g., indoor heat exchanger 122 and outdoor heat exchanger 120 may be between and in fluid communication with each other and compressor 126.

As may be seen in FIG. 3, sealed system 320 may also include a reversing valve 322. Reversing valve 322 selectively directs compressed refrigerant from compressor 126 to either indoor heat exchanger 122 or outdoor heat exchanger 120. For example, in a cooling mode, reversing valve 322 is arranged or configured to direct compressed, e.g., high-pressure, vapor refrigerant from compressor 126 to outdoor heat exchanger 120. Conversely, in a heating mode, reversing valve 322 is arranged or configured to direct compressed, e.g., high-pressure, vapor refrigerant from compressor 126 to indoor heat exchanger 122. Thus, reversing valve 322 permits sealed system 320 to adjust between the heating mode and the cooling mode, as will be understood by those skilled in the art.

During operation of sealed system 320 in the cooling mode, refrigerant flows from indoor heat exchanger 122 through compressor 126. For example, refrigerant may exit indoor heat exchanger 122 as a fluid in the form of a superheated vapor. Upon exiting indoor heat exchanger 122, the refrigerant may enter compressor 126. Compressor 126 is operable to compress the refrigerant. Accordingly, the pressure and temperature of the refrigerant may be increased in compressor 126 such that the refrigerant becomes a more superheated vapor.

Outdoor heat exchanger 120 is disposed downstream of compressor 126 in the cooling mode and acts as a condenser. Thus, outdoor heat exchanger 120 is operable to reject heat into the exterior atmosphere at rear opening 116, e.g., via outdoor outlet 130, when sealed system 320 is operating in the cooling mode. For example, the superheated vapor from compressor 126 may enter outdoor heat exchanger 120 from reversing valve 322. Within outdoor heat exchanger 120, the refrigerant transfers energy to the exterior atmosphere and condenses into a saturated liquid and/or liquid vapor mixture. An exterior air handler or fan 124 positioned adjacent outdoor heat exchanger 120 may facilitate or urge a flow of air from the exterior atmosphere across outdoor heat exchanger 120 in order to facilitate heat transfer.

Sealed system 320 also includes a plurality of branches, with an expansion device, e.g., one of a plurality of electronic expansion valves 324, disposed between indoor heat exchanger 122 and outdoor heat exchanger 120 on each branch. Refrigerant, which may be in the form of high liquid quality/saturated liquid vapor mixture, may exit outdoor heat exchanger 120 and travel through one or more of the branches and the respective electronic expansion valve or valves 324 before flowing through indoor heat exchanger 122 while sealed system 320 is operating in the cooling mode. The electronic expansion valve or valves 324 may generally expand the refrigerant, lowering the pressure and temperature thereof. The refrigerant may then be flowed through indoor heat exchanger 122. Additionally, each electronic expansion valve 324 may be actuated, such as by a stepper motor, to selectively increase or reduce the flow rate of refrigerant through any one or more of the electronic expansion valves 324.

Indoor heat exchanger 122 is disposed downstream of electronic expansion valves 324 in the cooling mode and acts as an evaporator. Thus, indoor heat exchanger 122 is operable to heat refrigerant within indoor heat exchanger 122 with energy from the indoor atmosphere at indoor portion 112 of housing 114 when sealed system 320 is operating in the cooling mode. For example, the liquid or liquid vapor mixture refrigerant from the one or more electronic expansion valves 324 (depending on which and how many electronic expansion valves 324 are opened, partially opened, or fully closed) may enter indoor heat exchanger 122. Within indoor heat exchanger 122, the refrigerant receives energy from the indoor atmosphere and vaporizes into superheated vapor and/or high quality vapor mixture. An indoor air handler or fan 142 positioned adjacent indoor heat exchanger 122 may facilitate or urge a flow of air from the indoor atmosphere across indoor heat exchanger 122 in order to facilitate heat transfer.

During operation of sealed system 320 in the heating mode, reversing valve 322 reverses the direction of refrigerant flow through sealed system 320. Thus, in the heating mode, indoor heat exchanger 122 is disposed downstream of compressor 126 and acts as a condenser, e.g., such that indoor heat exchanger 122 is operable to reject heat into the indoor atmosphere at indoor portion 112 of housing 114. In addition, outdoor heat exchanger 120 is disposed downstream of electronic expansion valves 324 in the heating mode and acts as an evaporator, e.g., such that outdoor heat exchanger 120 is operable to heat refrigerant within outdoor heat exchanger 120 with energy from the exterior atmosphere at outdoor portion 110 of housing 114.

Still referring to FIG. 3, the sealed system 320 may further include a drier-filter 326 with a check valve 328 and a bypass line 330. In such embodiments, the drier-filter 326 may be operable to remove water and other impurities from liquid refrigerant flowing to the indoor heat exchanger 122 when the sealed system 320 is operating in cooling mode, e.g., when the indoor heat exchanger 122 is operating as the evaporator. The bypass line 330 allows gas-phase refrigerant, e.g., when the refrigerant is in a mixed-phase state including both liquid and vapor refrigerant, to be directed around the drier-filter 326. The check valve 328 prevent refrigerant flow to the drier-filter 326 in heating mode.

Also as may be seen in FIG. 3, in some embodiments the sealed system 320 may include a plurality of branches, e.g., multiple refrigerant circuits 332 which diverge or branch out on one side of the drier-filter 326 and check valve 328 and which converge on the other side of the drier-filter 326 and check valve 328. For example, in cooling mode, the multiple refrigerant circuits 332 branch out downstream of the drier-filter 326 and check valve 328 and upstream of the indoor heat exchanger 122 and the multiple circuits 332 converge downstream of the outdoor heat exchanger 120 and upstream of the drier-filter 326, whereas in heating mode, the multiple refrigerant circuits 332 diverge or branch out upstream of the outdoor heat exchanger 120 and converge downstream of the indoor heat exchanger 122. It is to be understood that, in the schematic diagram of FIG. 3, portions of the multiple refrigerant circuits 332 are superimposed, e.g., stacked on top of each other, between the indoor heat exchanger 122 and the reversing valve 322, and between the reversing valve 322 and the outdoor heat exchanger 120, such that the multiple refrigerant circuits 332 appear as a single line in these sections due to the diagrammatic nature of the illustration in FIG. 3.

The sealed system 320 may also include a cross-over flow connection 334 that extends between each of the multiple refrigerant circuits 332 and the cross-over flow connection 334 may also provide fluid communication between each of the multiple refrigerant circuits 332. In some embodiments, the cross-over flow connection 334 may be downstream of the indoor heat exchanger 122 when the air conditioner unit operates in the heat pump mode, e.g., as illustrated in FIG. 3. For example, the cross-over flow connection 334 may be upstream of the expansion device(s) in the sealed system, such as upstream of the electronic expansion valves 324 when in the heat pump mode, as shown in FIG. 3. In additional embodiments, the cross-over flow connection 334 may be positioned on the other side of the electronic expansion valves 324, e.g., downstream of the electronic expansion valves 324 when the air conditioner unit is operating in heat pump mode.

The cross-over flow connection 334 may be sized relative to the multiple refrigerant circuits 332 such that at high pressure, high flow rate operating conditions each flow will remain in its respective circuit with little to no cross-over flow, whereas at lower pressures and slower flow rates the flow of refrigerant in one circuit 332 may spread to the other circuits 332 through the cross-over flow connection 334, maintaining flow stratification through the circuits in each heat exchanger 120, 122, e.g., maintaining flow stratification through top, middle, and bottom circuits, across a range of operating conditions of the air conditioner unit.

As mentioned, each refrigerant circuit 332 may include an expansion device, e.g., electronic expansion valve 324 coupled in-line therein. The electronic expansion valves 324 may be actuated by a motor, such as a stepper motor, and each motor may be in operative communication with the controller 158 whereby the controller may electronically actuate each electronic expansion valve 324, such as each electronic expansion valve 324 may actuable independently of every other electronic expansion valve 324. Thus, for example, one or more electronic expansion valve 324 may remain open, e.g., at least partially open, while the other electronic expansion valves 324 are fully closed. In particular, when the cross-over flow connection 334 is provided, refrigerant flow may be provided to all of the circuits, e.g., through each circuit of the indoor heat exchanger 122 and each circuit of the outdoor heat exchanger 120, even when one or more of the electronic expansion valves 324 is or are fully closed. In particular, at low-flow or low-pressure operating conditions, all of the multiple refrigerant circuits 332 may be controlled by a single valve 324 in one of the multiple refrigerant circuits 332 by fully closing all but one of the electronic expansion valves 324. Accordingly, use of the cross-over flow connection 334 may provide greater fidelity of control for the multiple refrigerant circuits 332, particularly at low-flow conditions, such as by providing a lower possible minimum flow across all circuits when some of the electronic expansion valves 324 are closed, such as when all but one electronic expansion valve 324 is closed, and the open electronic expansion valve 324, e.g., which may be only a single open electronic expansion valve 324 while all other electronic expansion valves 324 are closed, controls flow through all of the multiple refrigerant circuits 332. For example, each electronic expansion valve 324 may have a minimum open position, such that if there is no cross-over flow connection, the minimum flow through the multiple refrigerant circuits 332 would be the sum of all the minimum flows through every electronic expansion valve 324, whereas providing the cross-over flow connection 334 permits a single electronic expansion valve 324 to control all of the multiple refrigerant circuits 332, such that the minimum possible flow through the system is reduced to the minimum open position of just the one electronic expansion valve 324. Accordingly, in some embodiments, the lower limit of the air conditioner unit operating range may be reduced by about seventy-five percent (75%).

Figure 4:
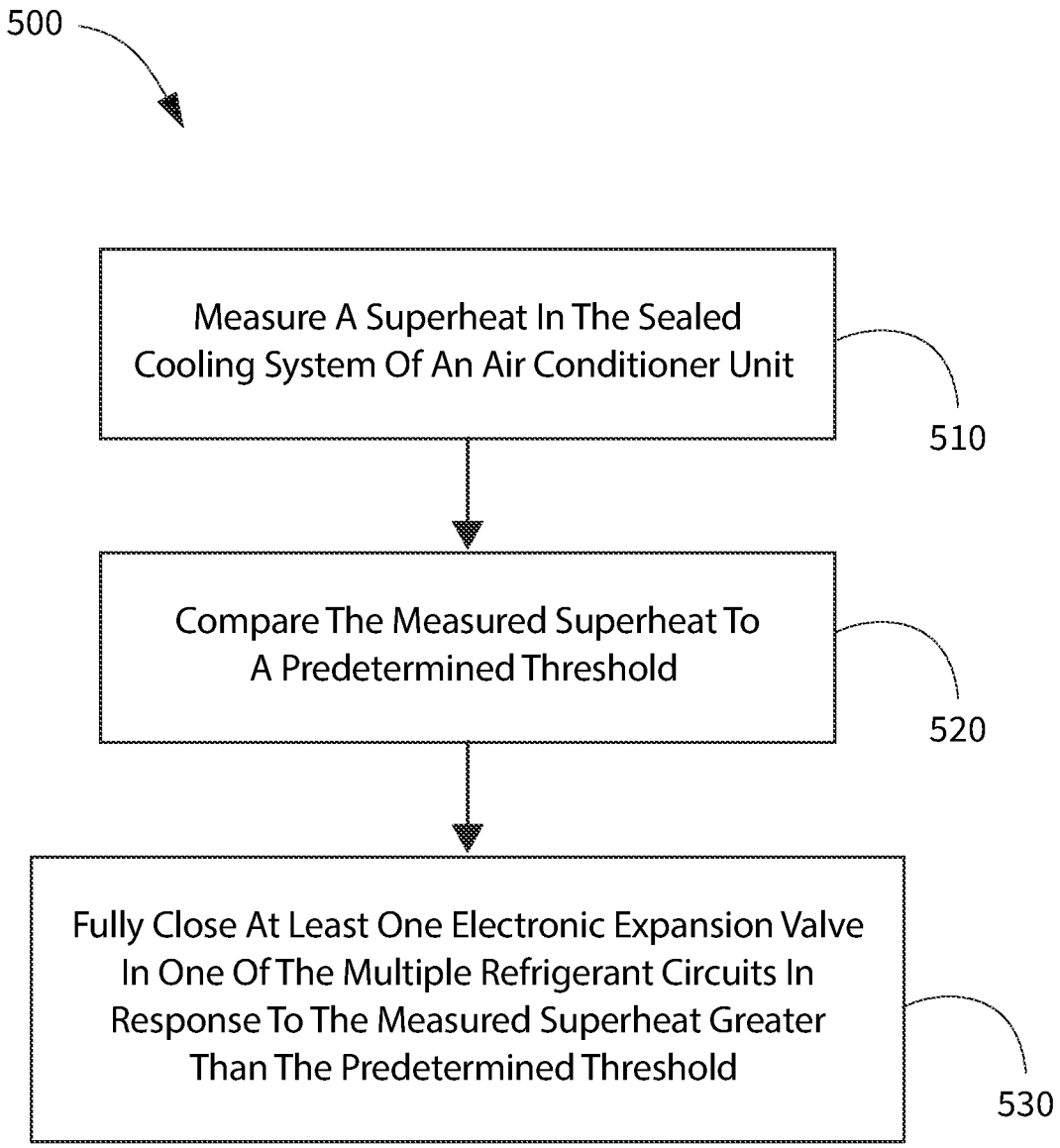
FIG. 4 provides a flowchart illustrating an exemplary method of operating an air conditioner unit according to one or more additional exemplary embodiments of the present disclosure.

Turning now to FIG. 4, embodiments of the present disclosure may also include methods of operating an air conditioner unit, such as the example method 500 illustrated in FIG. 4. Such methods may be used with any suitable air conditioner unit, such as air conditioner unit 100 as described above.

For example, as mentioned above, the air conditioner unit 100 may include a controller 158 and the controller 158 may be operable for, e.g., configured for, performing some or all of the methods and/or steps thereof described herein. For example, one or more method steps may be embodied as an algorithm or program stored in a memory of the controller 158 and executed by the controller 158 in response to a user input such as may be received via one or more user inputs 162.

In some embodiments, method 500 may only be performed in heat pump mode, e.g., method 500 may include a preliminary step of determining that the air conditioner unit is operating in a heat pump mode, such as receiving a user input for heat pump mode, or determining a heat pump mode based on an ambient temperature in the conditioned space, such as a difference between the measured ambient temperature in the conditioned space and a temperature setpoint, where the temperature setpoint may be derived from a user input or setting.

In some embodiments, method 500 may include a step 510 of measuring a superheat in the sealed cooling system. The superheat in the sealed cooling system may be measured based on a temperature difference across the evaporator of the sealed cooling system, e.g., across the outdoor heat exchanger 120 when in the heating mode. The superheat in the sealed cooling system may be measured based on a temperature difference between the inlet of the evaporator and the inlet of the compressor, or a temperature difference between the exit of the expansion device (e.g., electronic expansion valve) and the inlet of the compressor.

Method 500 may further include a step 520 of comparing the measured superheat to a predetermined threshold. When the measured superheat is greater than the predetermined threshold, method 500 may include fully closing at least one electronic expansion valve in one of the multiple refrigerant circuits in response to the measured superheat greater than the predetermined threshold (as indicated at 530 in FIG. 4), such as closing the electronic expansion valve in all of the multiple refrigerant circuits but one. Thus, the refrigerant flow may be throttled, bringing the superheat down to or closer to the desired value, e.g., the predetermined threshold. The predetermined threshold superheat may be any suitable value, and may depend in part on how the superheat is measured, e.g., the locations at which the different temperatures are measured. For example, the predetermined threshold superheat may be between about negative five degrees Fahrenheit (−5° F.) and about twenty degrees Fahrenheit (20° F.), such as between about zero degrees Fahrenheit (0° F.) and about ten degrees Fahrenheit (10° F.), such as between about one degree Fahrenheit (1° F.) and about five degrees Fahrenheit (5° F.), such as about two degrees Fahrenheit (2° F.).

Method 500 may be iterative. For example, the measuring step 510 and the comparing step 520 may be repeated, and when the measured superheat is greater than the predetermined threshold at a subsequent iteration, one or more additional electronic expansion valves may be fully closed. In some embodiments, when the measured superheat is less than the predetermined threshold, one or more of the electronic expansion valves in the multiple refrigerant circuits may be opened in response.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air conditioner unit, comprising:

an outdoor heat exchanger;

an indoor heat exchanger;

a sealed cooling system including the indoor heat exchanger and the outdoor heat exchanger, the sealed cooling system comprising multiple refrigerant circuits, wherein each refrigerant circuit of the multiple refrigerant circuits comprises an expansion device;

a cross-over flow connection extending between and providing fluid communication between each of the multiple refrigerant circuits, wherein the cross-over flow connection is adjacent the expansion device of each refrigerant circuit; and a reversing valve, whereby the air conditioner unit is operable in a heat pump mode when the reversing valve directs compressed vapor-phase refrigerant from a compressor of the sealed cooling system to the indoor heat exchanger, wherein the cross-over flow connection is downstream of the indoor heat exchanger when the air conditioner unit is in the heat pump mode, wherein each expansion device is downstream of the indoor heat exchanger when the air conditioner unit is in the heat pump mode.

2. The air conditioner unit of claim 1, wherein the cross-over flow connection is upstream of the expansion devices when the air conditioner unit is in the heat pump mode.

3. The air conditioner unit of claim 1, wherein the cross-over flow connection is downstream of the expansion devices when the air conditioner unit is in the heat pump mode.

4. The air conditioner unit of claim 1, wherein each of the expansion devices is an electronic expansion valve.

5. The air conditioner unit of claim 4, further comprising a controller, the controller in operative communication with each electronic expansion valve, wherein the controller is configured to measure a superheat in the sealed cooling system, compare the measured superheat to a predetermined threshold, and fully close at least one of the electronic expansion valves in response to the measured superheat greater than the predetermined threshold.

6. The air conditioner unit of claim 5, wherein the controller is configured to fully close all but one of the electronic expansion valves in response to the measured superheat greater than the predetermined threshold.

7. The air conditioner unit of claim 5, wherein measuring the superheat comprises measuring a temperature difference across the outdoor heat exchanger, wherein the air conditioner unit is operating in the heat pump mode and the outdoor heat exchanger is operating as an evaporator.

8. A method of operating an air conditioner unit, the air conditioner unit comprising an outdoor heat exchanger, an indoor heat exchanger, a sealed cooling system including the indoor heat exchanger and the outdoor heat exchanger, the sealed cooling system comprising multiple refrigerant circuits, and a cross-over flow connection extending between and providing fluid communication between each of the multiple refrigerant circuits, the method comprising:

measuring a superheat in the sealed cooling system;

comparing the measured superheat to a predetermined threshold; and fully closing at least one electronic expansion valve in one of the multiple refrigerant circuits in response to the measured superheat greater than the predetermined threshold, wherein, when the air conditioner unit is operating in a heat pump mode, the at least one electronic expansion valve is downstream of the indoor heat exchanger and the multiple refrigerant circuits diverge at a first point upstream of the outdoor heat exchanger and converge at a second point downstream of the indoor heat exchanger, and wherein the cross-over flow connection is positioned between the first point and the second point.

9. The method of claim 8, wherein fully closing at least one electronic expansion valve in one of the multiple refrigerant circuits comprises closing all but one electronic expansion valve of a plurality of electronic expansion valves, each electronic expansion valve of the plurality of electronic expansion valves in a respective one of the multiple refrigerant circuits of the sealed cooling system.

10. The method of claim 8, wherein measuring the superheat comprises measuring a temperature difference across the outdoor heat exchanger, wherein the air conditioner unit is operating in a heat pump mode and the outdoor heat exchanger is operating as an evaporator.

11. An air conditioner unit, comprising:

an outdoor heat exchanger;

an indoor heat exchanger;

a sealed cooling system including the indoor heat exchanger and the outdoor heat exchanger, the sealed cooling system comprising multiple refrigerant circuits;

a cross-over flow connection extending between and providing fluid communication between each of the multiple refrigerant circuits; and a controller, the controller configured for operating the air conditioner unit in a heat pump mode, and, while operating the air conditioner unit in the heat pump mode:

measuring a superheat in the sealed cooling system;

comparing the measured superheat to a predetermined threshold; and fully closing at least one valve in one of the multiple refrigerant circuits in response to the measured superheat greater than the predetermined threshold, wherein the at least one electronic expansion valve is downstream of the indoor heat exchanger, the multiple refrigerant circuits diverge at a first point upstream of the outdoor heat exchanger and converge at a second point downstream of the indoor heat exchanger, and the cross-over flow connection is positioned between the first point and the second point.

12. The air conditioner unit of claim 11, wherein fully closing at least one electronic expansion valve in one of the multiple refrigerant circuits comprises closing all but one electronic expansion valve of a plurality of electronic expansion valves, each electronic expansion valve of the plurality of electronic expansion valves in a respective one of the multiple refrigerant circuits of the sealed cooling system.

13. The air conditioner unit of claim 11, wherein measuring the superheat comprises measuring a temperature difference across the outdoor heat exchanger, wherein the air conditioner unit is operating in a heat pump mode and the outdoor heat exchanger is operating as an evaporator.

* * * * *